US010828529B1

(12) United States Patent
Liu

(10) Patent No.: US 10,828,529 B1
(45) Date of Patent: Nov. 10, 2020

(54) EXERCISE MACHINE

(71) Applicant: Dyaco International Inc., Taipei (TW)

(72) Inventor: Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 45 days.

(21) Appl. No.: 16/410,976

(22) Filed: May 13, 2019

(30) Foreign Application Priority Data

Apr. 22, 2019 (TW) ..... 108114018 A

(51) Int. Cl.
*A63B 22/00* (2006.01)
*A63B 21/00* (2006.01)

(52) U.S. Cl.
CPC ..... *A63B 22/0056* (2013.01); *A63B 21/151* (2013.01); *A63B 2022/0038* (2013.01); *A63B 2208/0204* (2013.01)

(58) Field of Classification Search
CPC ..... A63B 21/00058; A63B 21/00069; A63B 21/00076; A63B 21/005; A63B 21/0051; A63B 21/0052; A63B 21/0056; A63B 21/0057; A63B 21/15; A63B 21/151; A63B 21/154; A63B 21/159; A63B 21/22; A63B 21/225; A63B 21/227; A63B 21/4027; A63B 21/4033; A63B 21/4034; A63B 21/4045; A63B 21/4049; A63B 22/0015; A63B 22/0017; A63B 22/0025; A63B 22/0046; A63B 22/0048; A63B 22/0056; A63B 22/18; A63B 22/20; A63B 22/201; A63B 22/208; A63B 2022/0038; A63B 2022/206; A63B 23/035; A63B 23/03516; A63B 23/03533; A63B 23/03541; A63B 23/04; A63B 23/0405; A63B 23/0429; A63B 23/0482; A63B 23/0494; A63B 2023/0452; A63B 71/0054;
(Continued)

(56) References Cited

U.S. PATENT DOCUMENTS 4,509,742 A * 4/1985 Cones ..... A63B 22/001 138/45
5,072,929 A * 12/1991 Peterson ..... A63B 22/0012 482/72

(Continued)

FOREIGN PATENT DOCUMENTS

TW 277328 6/1996

OTHER PUBLICATIONS

Office Action dated Dec. 24, 2019 in corresponding Taiwan Patent Application No. 108114018.

*Primary Examiner* — Gary D Urbiel Goldner
(74) *Attorney, Agent, or Firm* — Donald E. Stout; Stout, Uxa & Buyan, LLP

(57) ABSTRACT

Embodiments of the present invention disclose an exercise machine including a supporting mechanism, two driving units, and a resistance device. The supporting mechanism supports the two driving units and the resistance device. The two driving units are respectively mounted at the left and the right side of the supporting mechanism for the user to operate. When the exercise machine is operated with a "small pace," the resistance device is operated in both directions to eliminate the blockage when switching the operating direction of the driving units. When the exercise machine is operated with a "large pace," the resistance device can provide resistance for the driving units in either direction.

9 Claims, 7 Drawing Sheets

(58) Field of Classification Search
CPC .... A63B 2071/0072; A63B 2071/0081; A63B 2208/0204
See application file for complete search history.

(56) References Cited

U.S. PATENT DOCUMENTS

| | | | | | |
|---|---|---|---|---|---|
| 5,356,356 | A * | 10/1994 | Hildebrandt | A63B 21/157 | 482/57 |
| 5,685,804 | A * | 11/1997 | Whan-Tong | A63B 22/001 | 482/51 |
| 5,792,026 | A * | 8/1998 | Maresh | A63B 22/001 | 482/51 |
| 6,234,939 | B1 * | 5/2001 | Moser | A63B 22/0007 | 482/57 |
| 6,893,382 | B1 * | 5/2005 | Moon | A63B 21/154 | 482/51 |
| 9,566,466 | B2 * | 2/2017 | Huang | A63B 22/04 | |
| 9,925,411 | B2 * | 3/2018 | Huang | A63B 21/225 | |
| 10,716,965 | B2 * | 7/2020 | Liu | A63B 21/154 | |
| 2002/0198083 | A1 * | 12/2002 | Goh | A63B 22/0664 | 482/57 |
| 2007/0298935 | A1 * | 12/2007 | Badarneh | A63B 22/0664 | 482/52 |
| 2008/0051258 | A1 * | 2/2008 | Schmehl | A63B 22/0015 | 482/52 |
| 2008/0051260 | A1 * | 2/2008 | Simonson | A63B 69/182 | 482/52 |
| 2016/0082311 | A1 * | 3/2016 | Massaro | A63B 22/0002 | 482/63 |
| 2019/0201730 | A1 * | 7/2019 | Smith | A63B 22/0664 | |
| 2019/0262661 | A1 * | 8/2019 | Stepanian | A63B 21/154 | |

* cited by examiner

EXERCISE MACHINE

CROSS-REFERENCE TO RELATED APPLICATIONS

The entire contents of Taiwan Patent Application No. 108114018, filed on Apr. 22, 2019, from which this application claims priority, are expressly incorporated herein by reference.

BACKGROUND OF THE INVENTION

1. Field of the Invention

The present invention relates to an exercise machine, and more particularly to an exercise machine for performing stepping exercise.

2. Description of Related Art

A stepper is an exercise machine that increases heart rate, burns calories, and improves myocardial endurance.

In the traditional stepper design, a user stands on two pedals supported by a given level of resistance. The user lifts alternating feet, as if walking up a set of stairs, so as to build muscle in legs and gluteus. The stair stepper is also a lower-impact training machine compared to a treadmill, making it useful for those with leg injuries.

U.S. Pat. No. 9,566,466 discloses an exercise device for stepping exercise, the main components of which include a frame, two pedals, two first swing arms, two second swing arms, a resistance device, two link rods, two cranks, and two limiting rods. The two pedals enable force to be applied. The two first swing arms are respectively arranged at left side and right side of the frame. The two second swing arms are respectively arranged at left side and right side of the frame, and both first swing arms and both second swing arms have two ends, a first end and a second end, in which the first end of the first swing arm pivotally couples to the frame, and the second end of the first swing arm couples to the first end of one corresponded second swing arm, and the second end of the corresponded second swing arm couples to one corresponded pedal. The resistance device includes a driving wheel and a flywheel. The driving wheel has an axle and couples with the flywheel. The two cranks are respectively arranged at left side and right side of the resistance device, and both cranks and both link rods have two ends, a first end and a second end, in which the first end of each crank couples to the axle, and the second end of each crank couples to a first end of one corresponded link rod, and the second end of the corresponded link rod couples to a portion between the first end and second end of one corresponded second swing arm. Each limiting rod slidably couples with one corresponded second swing arm and has two ends coupling to the frame. The motion of the pedals will drive the driving wheel, which in turn drives the flywheel to rotate.

Taiwan Patent No. M391978 discloses a linear climbing machine comprising a frame unit, a resistance unit, and two link units. The resistance unit includes a first pulley, a second pulley, and a resistance member (flywheel). The first pulley includes two cranks. Each link unit includes a rocker pivoted to the frame unit, a pedal rod pivotally connected to the rocker, a connecting rod pivoted between the rocker and one of the two cranks, and a sliding roller pivoted to the pedal rod. The stepping movement drives the first pulley via the crank, the first pulley drives the second pulley to rotate, and the second pulley drives the resistance member (flywheel) to rotate.

Taiwan Patent No. 1626073 discloses an exercise machine comprising: a main frame, a crank mechanism having two cranks disposed on the main frame; two swinging members being pivoted on both sides of the main frame; two bearing members with two front ends pivotally connected to the bottom end of the two swinging members and two rear end formed with two treading portions; two supporting rods having one end pivotally connected to the base of the main frame and the other end pivotally connected to the treading portion of the two bearing members; two connecting rods having an upper connecting portion pivoted to the two cranks and performs a circular path movement with the crank and having a lower connecting portion pivotally connected to the two supporting rods, and wherein the treading portions of the two bearing members are driven by the two connecting rods, and can be reciprocally moved along an arc shape. In addition, the exercise machine also includes a resistance device, which includes a flywheel and a pulley. A shaft of the pulley is connected to the two cranks, and the pulley is connected to the flywheel through a belt. The user's pedaling operation drives the pulley through the crank, and the pulley in turn drives the flywheel to rotate.

In a conventional stepper using a driving mechanism composed of linkage rods, when the stepping motion is performed, the inertia of the flywheel improves the smoothness of the pedaling operation, but this is limited to a large pace (that is, a large reciprocating distance of the pedal). When the stepper operates with a small pace, the inertia of the flywheel cannot immediately convert the stepping operation into the other direction, and hence there is blockage when switching the operation direction.

In addition, when conventional steppers operate with a large pace, only one operating direction (e.g., clockwise direction) is provided with resistance and no resistance is provided in the other direction.

SUMMARY OF THE INVENTION

In one general aspect, the present invention relates to an exercise machine, and more particularly relates to an exercise machine performing stepping movements.

According to an aspect of the present invention, an exercise machine is provided with a supporting mechanism, two driving units, and a resistance device. The supporting mechanism comprises a base located on a supporting plane or a floor and a frame located on the base and connected to the base. The two driving units are respectively disposed at a left side and a right side of the frame for the user to operate. The resistance device comprises a first transmission wheel, a second transmission wheel, a first axle, a first flywheel, a second flywheel, a third transmission wheel, a fourth transmission wheel, a first transmission member, and a second transmission member. The first and second transmission wheels are disposed at a first side and a second side of the frame, respectively. The first axle is a common axle of the first transmission wheel and the second transmission wheel. The first axle includes two ends with each connecting to one corresponded driving unit. The first flywheel and the second flywheel are mounted on the frame. The third transmission wheel is disposed at a side of the first flywheel and is connected to the first flywheel. The fourth transmission wheel is disposed at a side of the second flywheel and is connected to the second flywheel. The first transmission member connects the first transmission wheel and the third transmission wheel. The second transmission member connects the second transmission wheel and the fourth transmission wheel. The kinetic energy of the two driving units is transmitted to the third transmission wheel and the fourth transmission wheel via the first transmission wheel and the second transmission wheel, and then the third transmission wheel drives the first flywheel to rotate in a first direction or the fourth transmission wheel drives the second flywheel to rotate in a second direction.

In one embodiment, the exercise machine further comprises a second axle as a common axle of the third transmission wheel and the fourth transmission wheel.

In one embodiment, the exercise machine further includes a first one-way bearing disposed between the first flywheel and the third transmission wheel and a second one-way bearing disposed between the second flywheel and the fourth transmission wheel.

In one embodiment, the first transmission wheel, the second transmission wheel, the third transmission wheel, and the fourth transmission wheel are pulleys, and both the first transmission member and the second transmission member are belts.

In one embodiment, the resistance device further comprises a first tension wheel and a second tension wheel. The first tension wheel is disposed at a side of the first flywheel to adjust a tension of the first transmission member, and the second tension wheel is disposed at a side of the second flywheel to adjust a tension of the second transmission member.

In one embodiment, when the exercise machine is operated with "small pace," the first flywheel and the second flywheel are alternately rotated.

In one embodiment, when the exercise machine is operated with "large pace," the stepping of the two pedals controls the rotating direction of the first transmission wheel and the second transmission wheel, causing one of the first flywheel and the second flywheel to rotate and the other to rest.

In one embodiment, each driving unit comprises: a swing rod having a first end pivotally connected to the frame; a foot rod having a first end pivotally connected to a second end of the swing rod; a crank having a first end connected to the first axle; a linkage rod having a first end pivotally connected to a second end of the crank and having a second end pivotally connected to a portion between the first end and the second end of the foot rod; a limiting rod having a first end fixed to the frame and having a second end fixed to the base; and a pedal connecting to a second end of the foot rod.

BRIEF DESCRIPTION OF THE DRAWINGS

FIG. 3A is a perspective view of a resistance device of the exercise machine shown in

FIG. 1.

DETAILED DESCRIPTION OF THE PREFERRED EMBODIMENT

Figure 1:
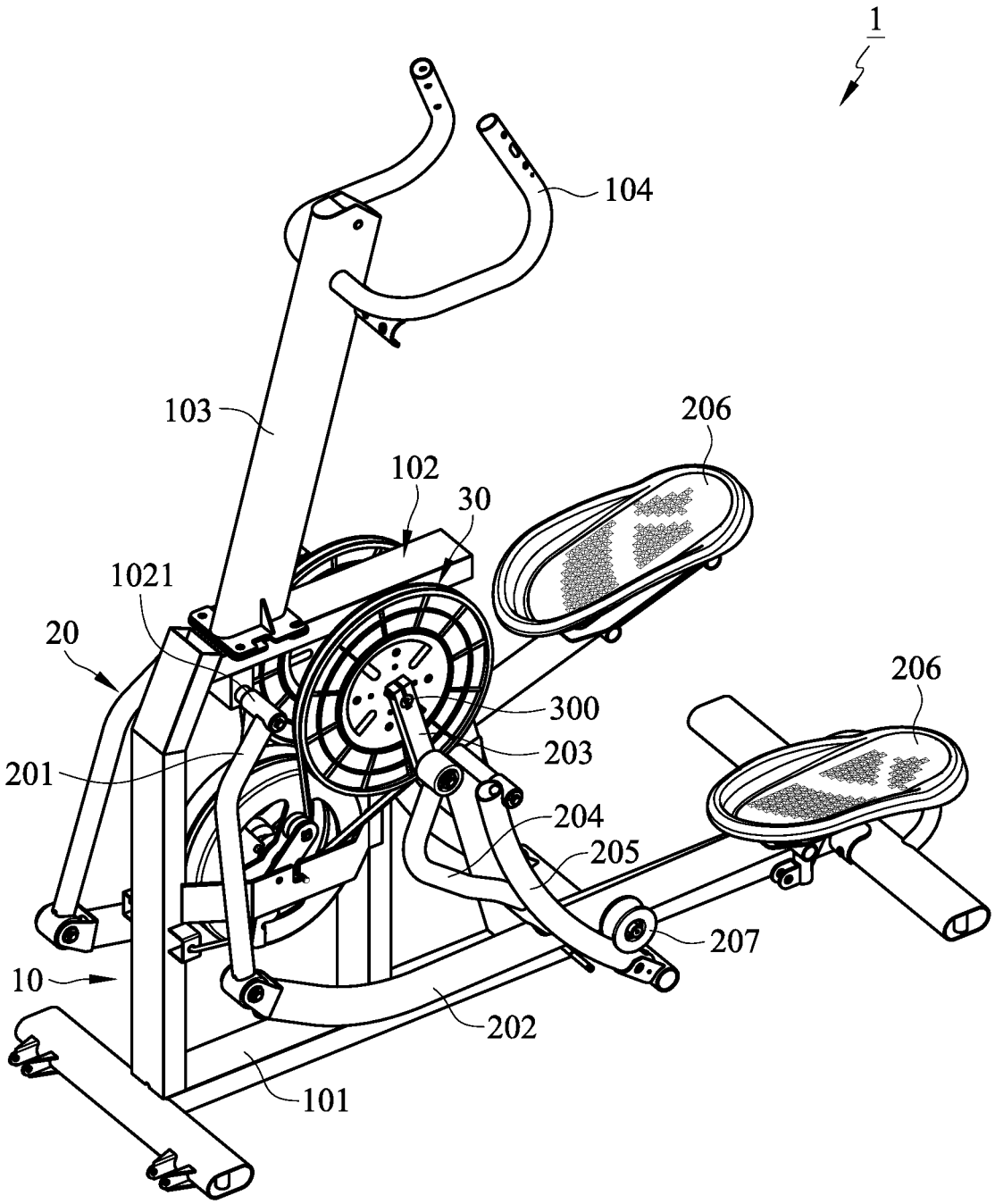
FIG. 1 is a perspective view of an exercise machine provided in accordance with a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
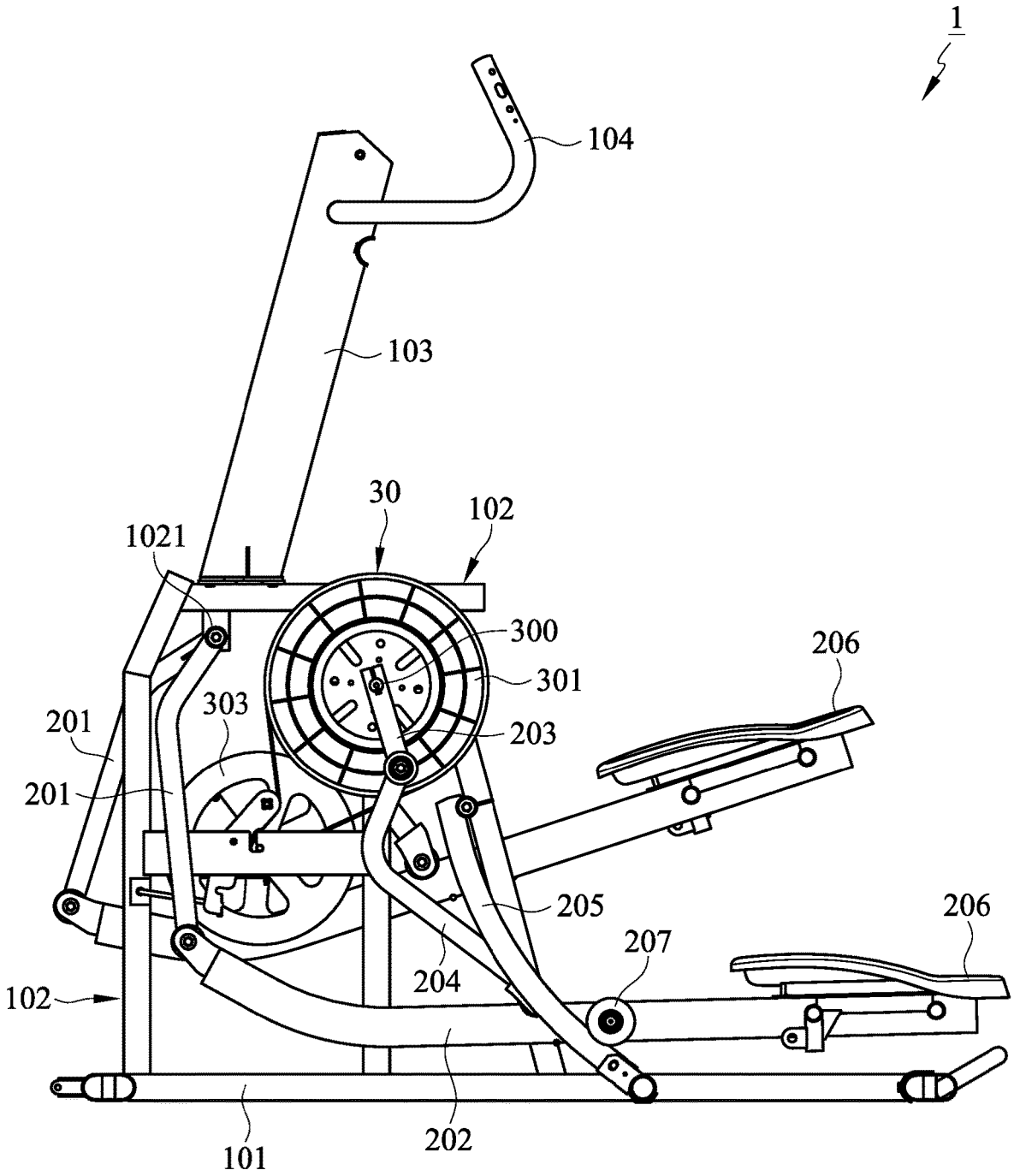
FIG. 2 is a side view of the exercise machine provided in accordance with the preferred embodiment of the present invention.

FIG. 1 is a perspective view of an exercise machine 1 provided by a preferred embodiment of the present invention. FIG. 2 is a side view of the exercise machine 1. As shown in FIGS. 1 and 2, the exercise machine 1 mainly includes a supporting mechanism 10, two (left and right) driving units 20, and a resistance device 30. The supporting mechanism 10 is used to support the driving unit 20 and the resistance device 30. The driving unit 20 is operated by a user and transmits the kinetic energy applied by the user to the resistance device 30. The driving unit 30 operably couples to the resistance device 30, which provides the resistance when the driving unit 20 is operated by the user.

Referring to FIGS. 1 to 2, the supporting mechanism 10 preferably includes, but is not limited to, a base 101 and a frame 102. The base 101 is disposed on a floor or a supporting plane, and the frame 102 is a supporting structure located above the base 101 and coupled to the base 101. The supporting mechanism 10 can also include a post 103. The lower end of the post 103 is connected to the frame 102. The upper end of the post 103 has handles 104 for the user to hold and an operation interface (not shown) for the user to operate and control the exercise machine 1.

As shown in FIGS. 1 and 2, the two driving units 20 are respectively disposed at the left side and right side of the frame 102. Each driving unit 20 preferably includes, but is not limited to: a swing rod 201, a foot rod 202, a crank 203, a linkage rod 204, a limiting rod 205, and a pedal 206.

As shown in FIGS. 1 and 2, a first end of the swing rod 201 is pivotally connected to an axis 1021 of the frame 102, and a second end of the swing rod 201 is pivotally connected to a first end of the foot rod 202, and a second end of the foot rod 202 is coupled to the pedal 206. A first end of the crank 203 is connected to a first axle 300 of the resistance device 30, a second end of the crank 203 is pivotally connected to a first end of the linkage rod 204, and a second end of the linkage rod 204 is pivotally connected to an portion between the first end and the second end of the foot rod 202. A first end of the limiting rod 205 is fixed with the frame 102, and a second end of the limiting rod 205 is fixed with the base 101. Preferably, the limiting rod 205 is curve-shaped. In one embodiment, the limiting rod 205 may be straight.

As shown in FIGS. 1 and 2, preferably, each driving unit 20 further includes a roller 207. The axis of the roller 207 is pivoted on the outer side surface between the first end and the second end of the foot rod 202. The roller 207 has a concave groove to fit the limiting rod 205 such that the roller 207 abuts against the curved limiting rod 205. When the pedals 206 are alternately operated, the rollers 207 are moved up and down along the limiting rods 205. The roller 207 can improve the stability of the pedal 206 during movements.

Figure 3A:
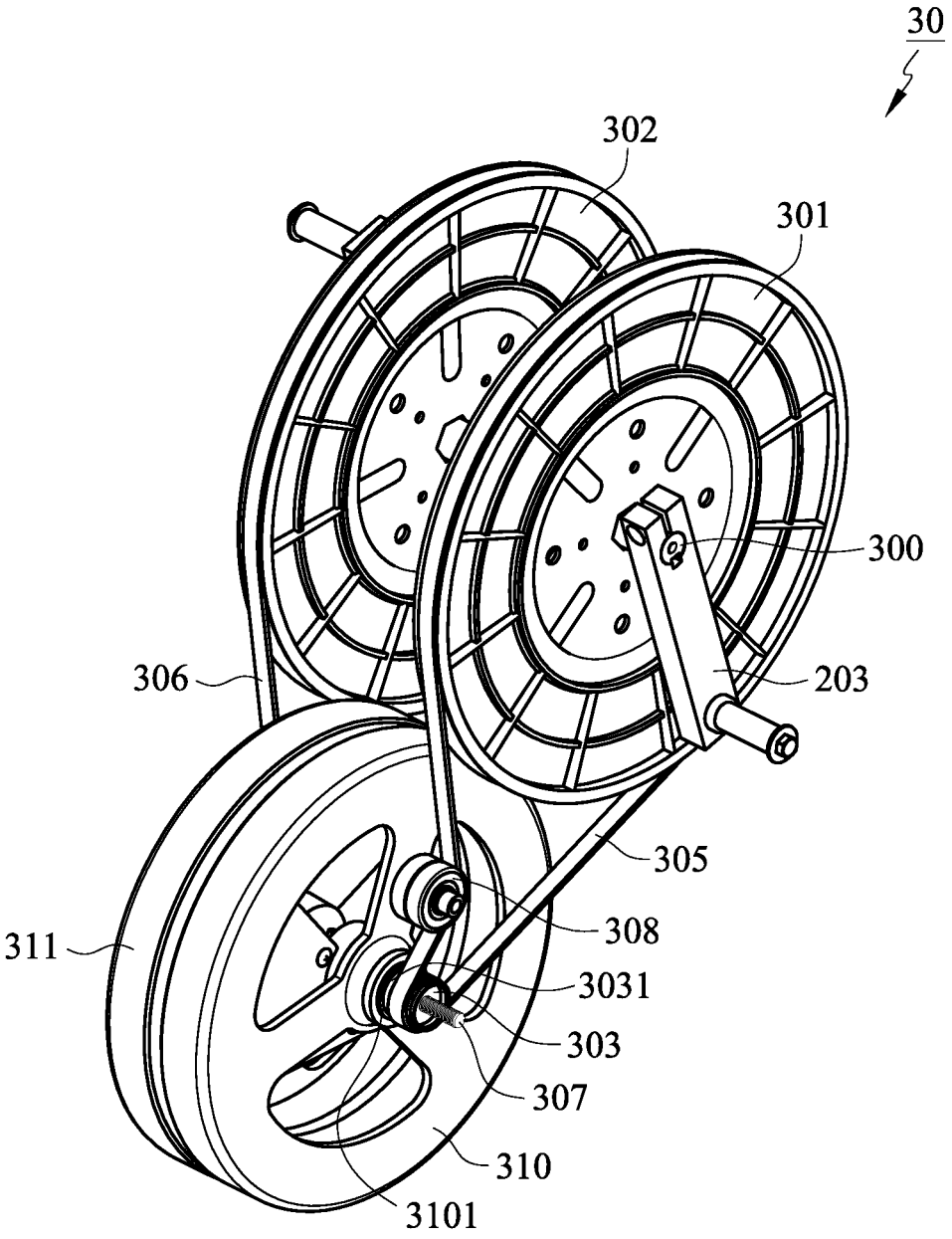
Figure 3B:
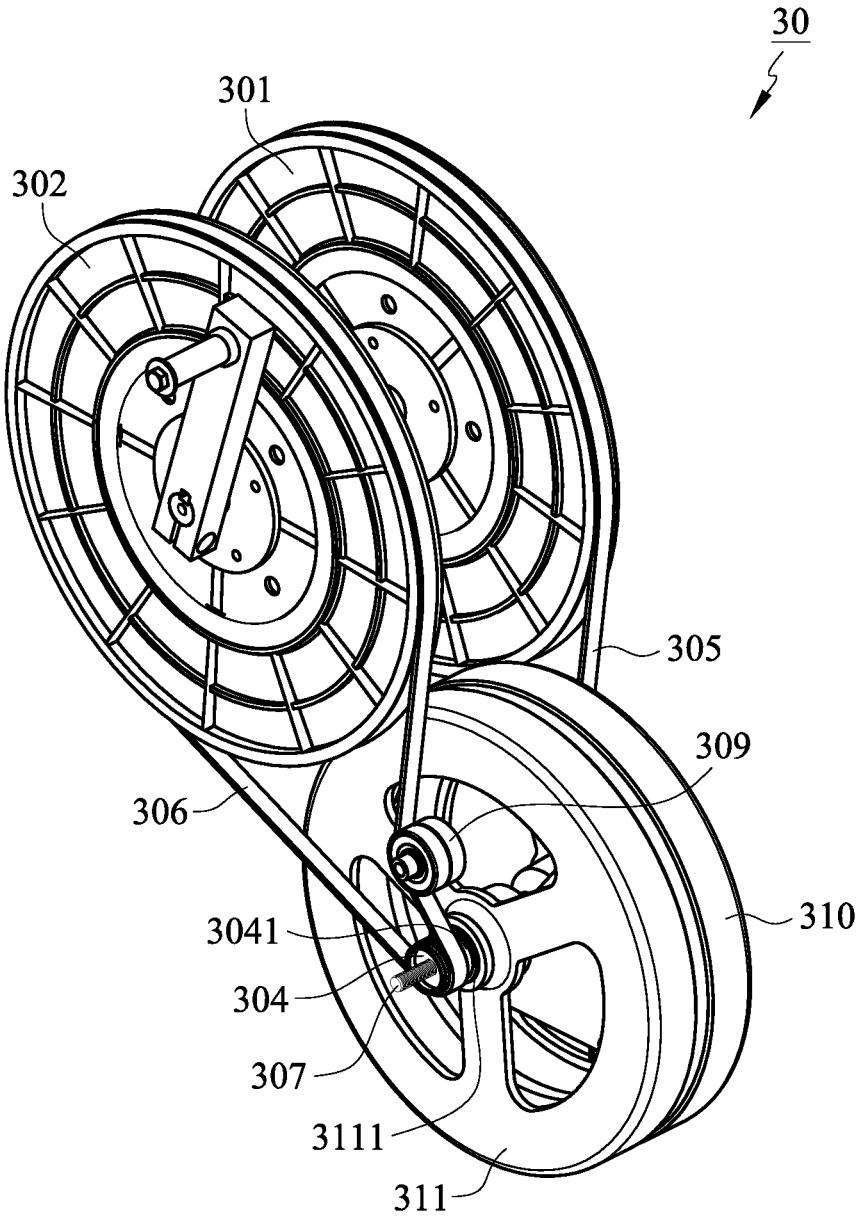
FIG. 3B is another perspective view of the resistance device of the exercise machine shown in FIG. 1.
Figure 3C:
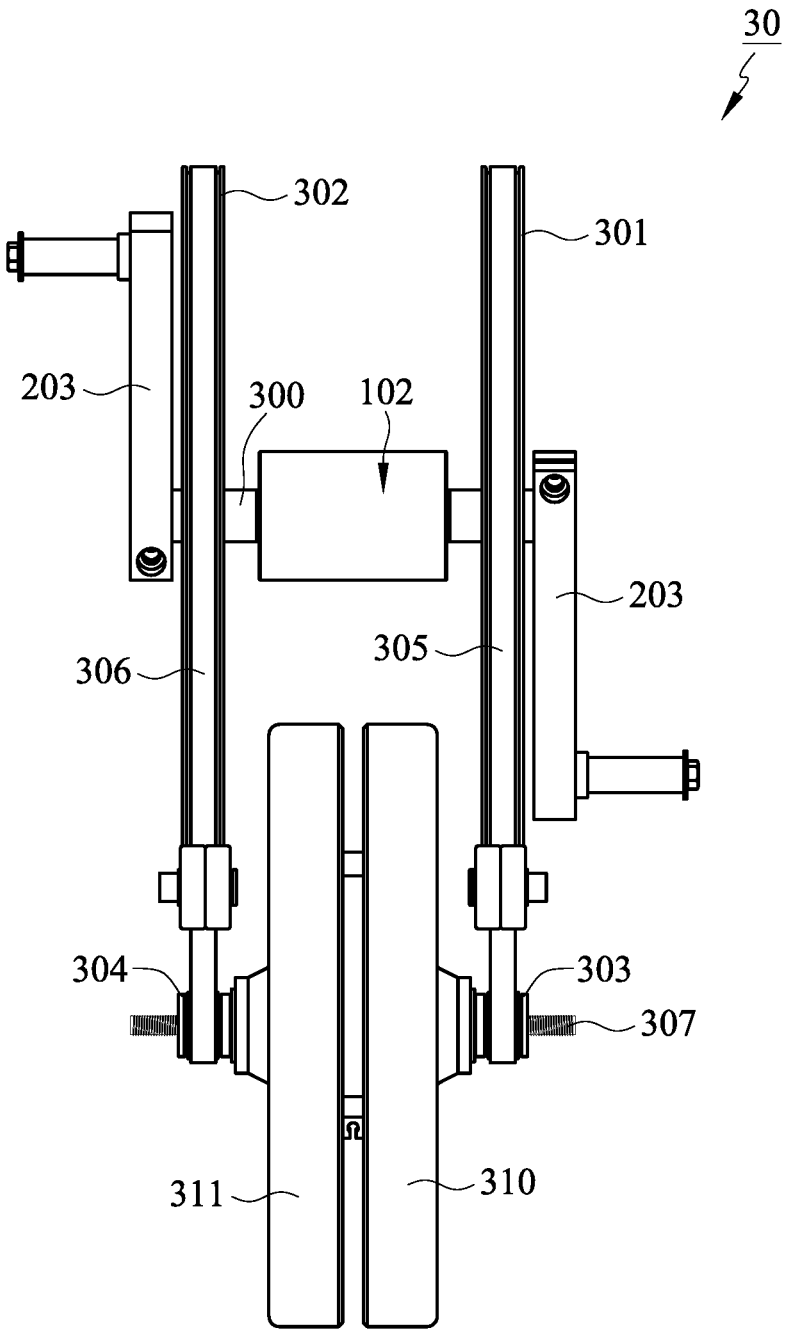
FIG. 3C is a side view of the resistance device of the exercise machine shown in FIG. 1.

FIGS. 3A and 3B are perspective views of the resistance device 30 in two different viewing angles. FIG. 3C is a side view of the resistance device 30 of FIG. 1. As shown in FIGS. 3A, 3B, and 3C, the resistance device 30 mainly includes the first axle 300, a first transmission wheel 301, a second transmission wheel 302, a third transmission wheel 303, a fourth transmission wheel 304, a first transmission member 305, a second transmission member 306, a second axle 307, a first flywheel 310, and a second flywheel 311.

As shown in FIGS. 3A, 3B, and 3C, the first transmission wheel 301 and the second transmission wheel 302 are respectively disposed at the left side and right side of the frame 102, and the first axle 300 is a common axle of the first transmission wheel 301 and the second transmission wheel 302. The first axle 300 passes through the frame 102 and includes two ends respectively connects with the first end of one crank 23. The two cranks 23 are oppositely disposed by 180 degrees, and the kinetic energy generated by operating the pedals 26 is transmitted to the first axle 300 through the cranks 23, and then transmitted from the first axle 300 to the first transmission wheel 301 and the second transmission wheel 302, so as to drive the first transmission wheel 301 and the second transmission wheel 302 to rotate.

As shown in FIGS. 3A, 3B, and 3C, the first flywheel 310 and the second flywheel 311 are supported by the frame 102, the third transmission wheel 303 is disposed at a side of the first flywheel 310, and the fourth transmission wheel 304 is disposed at a side of the second flywheel 311. The second axle 307 is a common axle of the third transmission wheel 303 and the fourth transmission wheel 304. In one embodiment, the first flywheel 310 and the second flywheel 311 provide magnetic resistance. The first transmission wheel 301 is connected to the third transmission wheel 303 through the first transmission member 305, and the second transmission wheel 302 is connected to the fourth transmission wheel 304 through the second transmission member 306. In addition, referring to FIG. 3A, the diameter of the third transmission wheel 303 is smaller than the diameter of the first flywheel 310, and a portion 3031 of the third transmission wheel 303 is axially extended to the center of the first flywheel 310. In addition, a first one-way bearing 3101 is disposed between the first flywheel 310 and the periphery of the portion 3031 of the third transmission wheel 303. Referring to FIG. 3B, the diameter of the fourth transmission wheel 304 is smaller than the diameter of the second flywheel 311, and a portion 3041 of the fourth transmission wheel 304 is axially extended to the center of the second flywheel 311. In addition, a second one-way bearing 3111 is disposed between the periphery of the portion 3041 and the fourth transmission wheel 304. Accordingly, the rotation of the first transmission wheel 301 and the second transmission wheel 302 will cause the first flywheel 310 or the second flywheel 311 to rotate. It is appreciated that the first flywheel 310 rotates in a first direction and second flywheel 311 rotates in a second direction opposite to the first direction, or vice versa.

Referring to FIGS. 3A, 3B, and 3C, preferably, the first transmission wheel 301, the second transmission wheel 302, the third transmission wheel 303, and the fourth transmission wheel 304 are pulleys, and both the first transmission member 305 and the second transmission member 306 are belts.

Referring to FIGS. 3A, 3B, and 3C, in the present embodiment, the resistance device 30 may further include a first tension wheel 308 and a second tension wheel 309. The first tension wheel 308 is disposed at a side of the first flywheel 310 to adjust the tension of the first transmission member 305, and the second tension wheel 309 is disposed at a side of the second flywheel 311 to adjust the tension of the second transmission member 306. Preferably, both the first tension wheel 308 and the second tension wheel 309 are pulleys.

Figure 4:
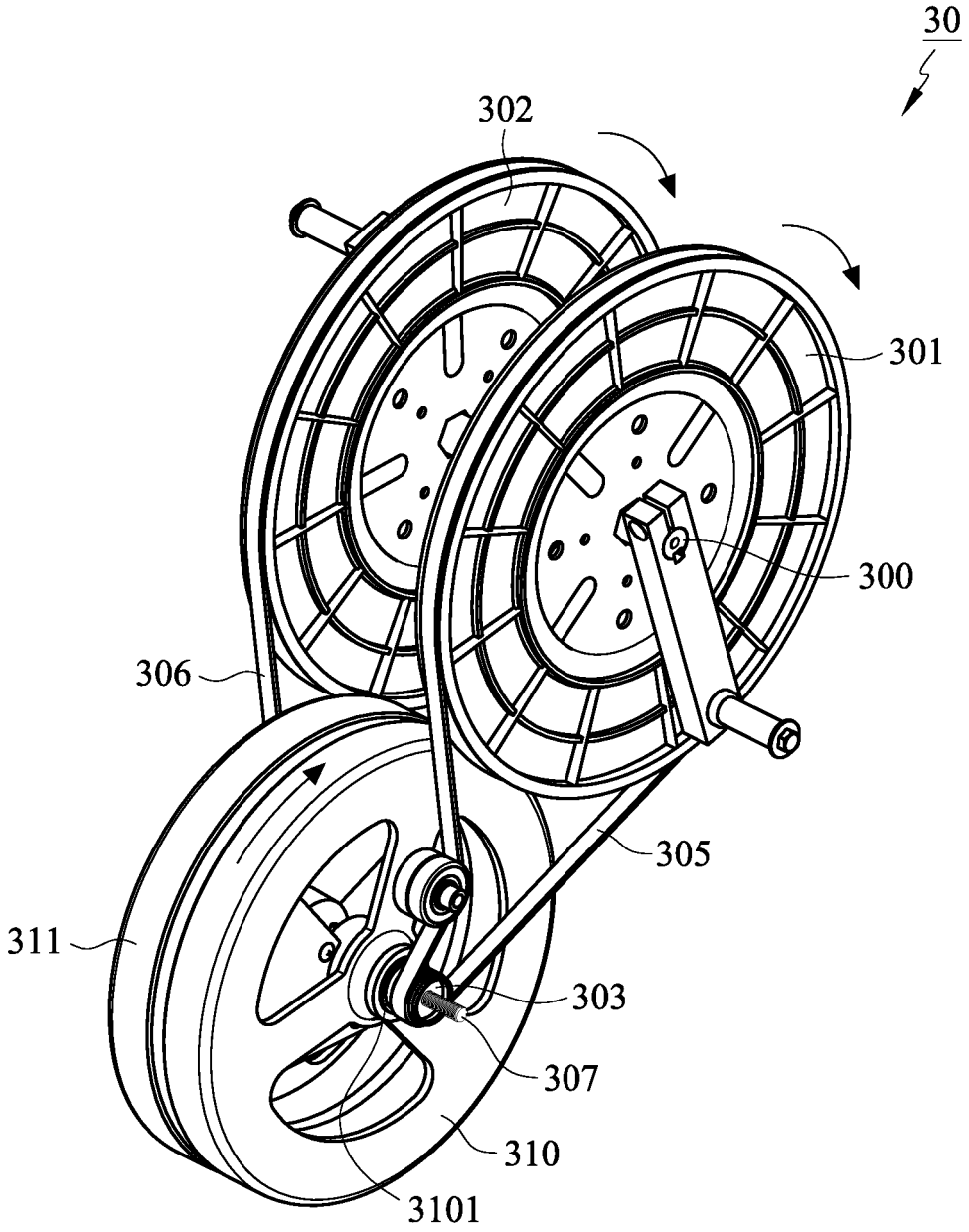
FIG. 4 is a schematic diagram showing the operation of the resistance device of the exercise machine of FIG. 1.
Figure 5:
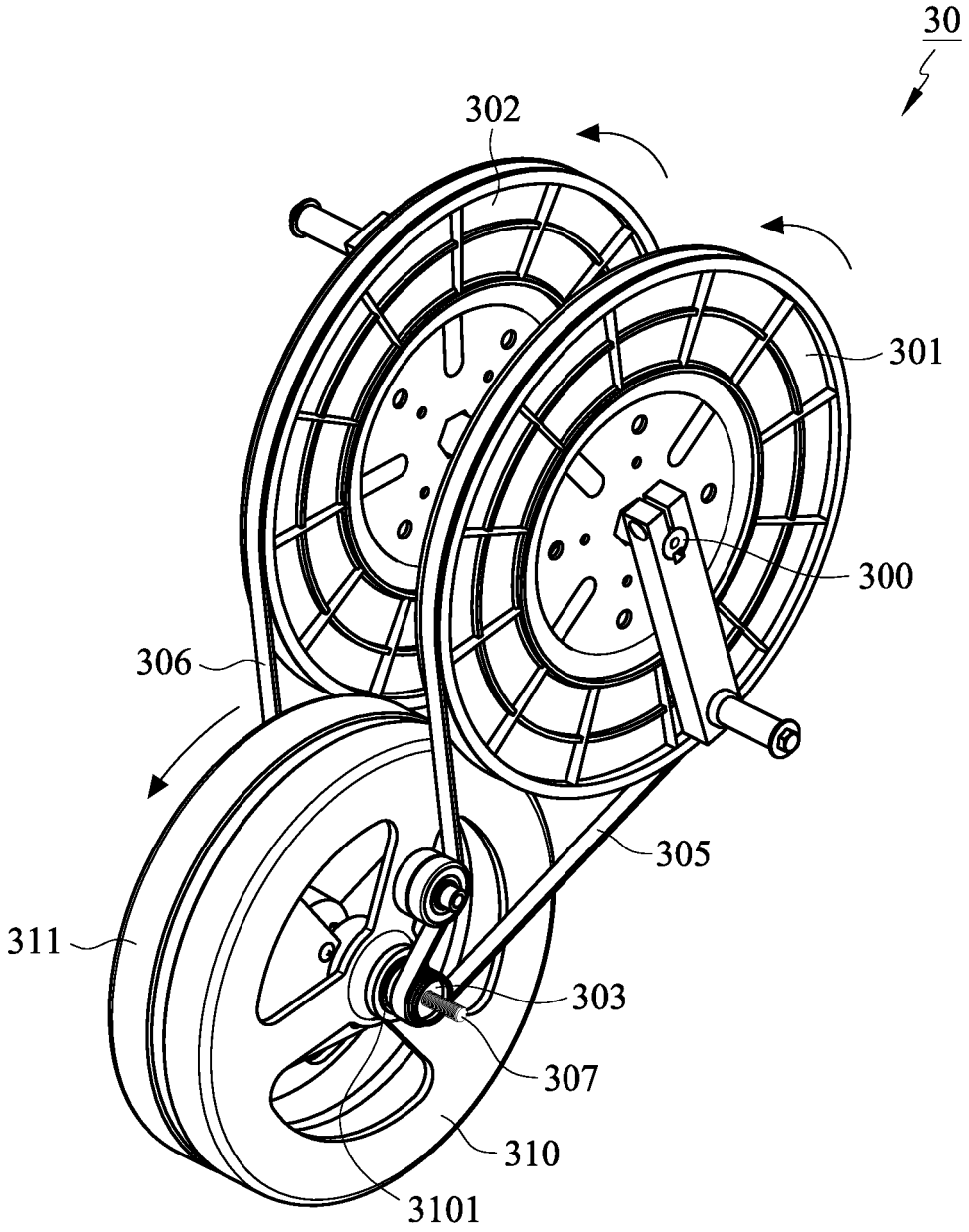
FIG. 5 is a schematic diagram showing the operation of the resistance device of the exercise machine of FIG. 1.

FIGS. 4 and 5 are schematic diagrams showing the operation of the resistance device 30 of the exercise machine 1 according to an embodiment of the present invention, wherein the exercise machine is operated with "small pace." In the context, "large pace" means that each pedal 26 is reciprocated between its highest position and the lowest position, and "small pace" means that each pedal 26 is operated with a reciprocal path that is shorter than the "large pace."

Referring to FIG. 4, when the user operates the pedals 26, the kinetic energy is transmitted from the cranks 23 to the first axle 300 and drives the first transmission wheel 301 and the second transmission wheel 302 to rotate in a first direction (for example, clockwise direction). The first transmission wheel 301 and the second transmission wheel 302 then respectively drive the third transmission wheel 303 and the fourth transmission wheel 304 to rotate in the first direction. At this time, the second one-way bearing 3111 (FIG. 3B) in the second flywheel 311 is loosened from the fourth transmission wheel 304, and the first one-way bearing 3101 in the first flywheel 310 is engaged with the third transmission wheel 303. At this time, the kinetic energy is transmitted to the third transmission wheel 303 via the first transmission member 305 and is then transmitted to the first flywheel 310, causing that the first flywheel 310 rotates in a first direction (e.g., clockwise) and the second flywheel 311 remains stationary.

Referring to FIG. 5, when the user operates the pedals 26, the kinetic energy is transmitted from the cranks 23 to the first axle 300 and drives the first transmission wheel 301 and the second transmission wheel 302 to rotate in a second direction (for example, counterclockwise direction). The first transmission wheel 301 and the second transmission wheel 302 then respectively drive the third transmission wheel 303 and the fourth transmission wheel 304 to rotate in the second direction. At this time, the second one-way bearing 3111 in the second flywheel 311 is engaged with the fourth transmission wheel 304, and the first one-way bearing 3101 in the first flywheel 310 is loosened from the third transmission wheel 303. At this time, the kinetic energy is transmitted to the fourth transmission wheel 304 via the second transmission member 306 and is then transmitted to the second flywheel 311, causing that the second flywheel 311 rotates in a second direction (e.g., counterclockwise direction) and the first flywheel 310 remains stationary.

Accordingly, as shown in FIGS. 4-5, when the exercise machine 1 is operated with the "small pace," the stepping reciprocal movements of the pedals 206 will cause the alternate rotation of the first flywheel 310 and the second flywheel 311.

In addition, when the exercise machine 1 is operated with the "large pace," the operation of the resistance device 30 is similar to FIG. 4 or FIG. 5, and the resistance device 30 can provide resistance for the pedals 206 in either operating direction.

Referring to FIG. 4, when the stepping movements cause each pedal 206 reciprocating between its highest position and the lowest position, both the first transmission wheel 301 and the second transmission wheel 302 rotate in a first direction (e.g., clockwise direction), and the kinetic energy is transmitted to the third transmission wheel 303 and the fourth transmission wheel 304 via the first transmission member 305 and the second transmission member 306. Due to the engagement of the first one-way bearing 3101 and the inertia of the first flywheel 310, the first flywheel 310 continually rotates in the first direction, and the second flywheel 311 remains stationary. Alternatively, referring to FIG. 5, when the stepping movements cause each pedal 206 reciprocating between its highest position and the lowest position, both the first transmission wheel 301 and the second transmission wheel 302 rotate in a second direction (e.g., counterclockwise direction), and the kinetic energy is transmitted to the third transmission wheel 303 and the fourth transmission wheel 304 via the first transmission member 305 and the second transmission member 306. Due to the engagement of the second one-way bearing 3111 and the inertia of the second flywheel 311, the second flywheel 311 continually rotates in the second direction, and the first flywheel 310 remains stationary. Accordingly, the resistance device 30 can provide resistance for the pedals 206 in either operating direction.

According to the embodiments of the present invention, when the exercise machine 1 is operated with the "small pace," the first transmission wheel 301 and the second transmission wheel 302 are alternately rotated in the first direction and the second direction, causing the alternate rotation of the first flywheel 310 and the second flywheel 311. The exercise machine 1 can be smoothly operated with the "small pace," regardless the first transmission wheel 301 and the second transmission wheel 302 being rotated in the first direction or the second direction. Further, when the exercise machine 1 is operated with the "large pace," one of the first flywheel 310 and the second flywheel 311 can provide resistance to each pedal 206 in its either operating direction.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise machine, comprising:

a supporting mechanism comprising a base located on a supporting plane or a floor and comprising a frame located on the base and connected to the base;

two driving units being respectively disposed at a left side and a right side of the frame configured for a user to operate; and a resistance device comprising:

a first transmission wheel being disposed at a first side of the frame;

a second transmission wheel being disposed at a second side of the frame;

a first axle being a common axle of the first transmission wheel and the second transmission wheel, the first axle having two ends with each connecting to one corresponded driving unit;

a first flywheel being mounted on the frame;

a second flywheel being mounted on the frame;

a third transmission wheel being disposed at a side of the first flywheel and being connected to the first flywheel;

a fourth transmission wheel being disposed at a side of the second flywheel and being connected to the second flywheel;

a first one-way bearing being disposed between the first flywheel and the third transmission wheel;

a second one-way bearing being disposed between the second flywheel and the fourth transmission wheel;

a first transmission member connecting the first transmission wheel and the third transmission wheel; and a second transmission member connecting the second transmission wheel and the fourth transmission wheel;

wherein a kinetic energy of the two driving units is respectively transmitted to the third transmission wheel and the fourth transmission wheel via the first transmission wheel and the second transmission wheel, respectively, and then the third transmission wheel drives the first flywheel to rotate in a first direction or the fourth transmission wheel drives the second flywheel to rotate in a second direction.

2. The exercise machine as recited in claim 1, further comprising a second axle as a common axle of the third transmission wheel and the fourth transmission wheel.

3. The exercise machine as recited in claim 1, wherein the first transmission wheel, the second transmission wheel, the third transmission wheel, and the fourth transmission wheel are pulleys, and both the first transmission member and the second transmission member are belts.

4. The exercise machine as recited in claim 3, wherein the resistance device further comprises a first tension wheel and a second tension wheel, and wherein the first tension wheel is disposed at a side of the first flywheel to adjust a tension of the first transmission member, and the second tension wheel is disposed at a side of the second flywheel to adjust a tension of the second transmission member.

5. The exercise machine as recited in claim 1, wherein when the exercise machine is operated with a "small pace," the first flywheel and the second flywheel are alternately rotated.

6. The exercise machine as recited in claim 1, wherein when the exercise machine is operated with a "large pace," stepping movements of the two driving units control a rotating direction of the first transmission wheel and the second transmission wheel, respectively, causing one of the first flywheel and the second flywheel to rotate and the other of the first flywheel and the second flywheel to rest.

7. The exercise machine as recited in claim 1, wherein each of the two driving units comprises:

a swing rod having a first end pivotally connected to the frame;

a foot rod having a first end pivotally connected to a second end of the swing rod;

a crank having a first end connected to the first axle;

a linkage rod having a first end pivotally connected to a second end of the crank and having a second end pivotally connected to a portion between the first end and a second end of the foot rod;

a limiting rod having a first end fixed to the frame and having a second end fixed to the base; and a pedal connected to the second end of the foot rod.

8. The exercise machine as recited in claim 7, wherein the limiting rod is curve-shaped.

9. The exercise machine as recited in claim 7, wherein each of the two driving units further comprises a roller that comprises an axis pivoted to an outer side surface between the first end and the second end of the foot rod.

* * * * *